US009932999B2

(12) United States Patent
Ueda

(10) Patent No.: US 9,932,999 B2
(45) Date of Patent: Apr. 3, 2018

(54) HYDRAULIC CIRCUIT FOR CONSTRUCTION MACHINE

(71) Applicant: KOBELCO CONSTRUCTION MACHINERY CO., LTD., Hiroshima-shi (JP)

(72) Inventor: Koji Ueda, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 374 days.

(21) Appl. No.: 14/443,471

(22) PCT Filed: Nov. 19, 2013

(86) PCT No.: PCT/JP2013/006799

§ 371 (c)(1),
(2) Date: May 18, 2015

(87) PCT Pub. No.: WO2014/091685

PCT Pub. Date: Jun. 19, 2014

(65) Prior Publication Data

US 2015/0275939 A1 Oct. 1, 2015

(30) Foreign Application Priority Data

Dec. 13, 2012 (JP) ..... 2012-272217

(51) Int. Cl.
*F15B 21/14* (2006.01)
*E02F 9/22* (2006.01)
(Continued)

(52) U.S. Cl.
CPC ..... *F15B 21/14* (2013.01); *E02F 9/14* (2013.01); *E02F 9/2217* (2013.01);
(Continued)

(58) Field of Classification Search
CPC ..... F15B 11/024; F15B 2011/0246; F15B 2211/86; F15B 2211/863; F15B 2211/88; E02F 9/2217
See application file for complete search history.

(56) References Cited

U.S. PATENT DOCUMENTS 7,530,434 B2 * 5/2009 Bitter ..... B66F 9/0655 188/151 R
2008/0110166 A1 * 5/2008 Stephenson ..... E02F 9/2217 60/414
(Continued)

FOREIGN PATENT DOCUMENTS

EP 2 204 504 A1 7/2010
EP 2 799 727 A1 11/2014
(Continued)

OTHER PUBLICATIONS

International Search Report dated Feb. 4, 2014 in PCT/JP2013/006799 Filed Nov. 19, 2013.
(Continued)

*Primary Examiner* — Michael Leslie
*Assistant Examiner* — Matthew Wiblin
(74) *Attorney, Agent, or Firm* — Oblon, McClelland, Maier & Neustadt, L.L.P.

(57) ABSTRACT

A hydraulic circuit changeable between a state of executing a regeneration action and a state of stopping the regeneration action. The hydraulic circuit includes hydraulic pumps; a plurality of hydraulic actuators; a plurality of control valves provided for respective hydraulic actuators; a regeneration line through which return oil returned from a specific hydraulic actuator of the hydraulic actuators to a tank is supplied to a regeneration target; a regeneration valve; a meter-out valve; and a flow-path selection device selecting a flow path for the return oil from a first flow path supplying the return oil to the regeneration line to cause the regenera-
(Continued)

tion action and a second flow path supplying the return oil to the control valve for the specific hydraulic actuator to stop the regeneration action.

4 Claims, 2 Drawing Sheets

(51) Int. Cl.
*E02F 9/14* (2006.01)
*E02F 9/26* (2006.01)

(52) U.S. Cl.
CPC ..... *E02F 9/2285* (2013.01); *E02F 9/2289* (2013.01); *E02F 9/2292* (2013.01); *E02F 9/268* (2013.01); *F15B 2211/20576* (2013.01); *F15B 2211/30505* (2013.01); *F15B 2211/3157* (2013.01); *F15B 2211/41527* (2013.01); *F15B 2211/41581* (2013.01); *F15B 2211/426* (2013.01); *F15B 2211/46* (2013.01); *F15B 2211/611* (2013.01); *F15B 2211/6316* (2013.01); *F15B 2211/7142* (2013.01); *F15B 2211/761* (2013.01); *F15B 2211/88* (2013.01)

(56) References Cited

U.S. PATENT DOCUMENTS

| | | | | |
|---|---|---|---|---|
| 2009/0036264 | A1* | 2/2009 | Tozawa | B60K 6/22 477/5 |
| 2014/0026550 | A1* | 1/2014 | Brinkman | F15B 21/14 60/414 |
| 2014/0137548 | A1* | 5/2014 | Imura | E02F 9/123 60/420 |

FOREIGN PATENT DOCUMENTS

| | | |
|---|---|---|
| JP | 2003 120604 | 4/2003 |
| JP | 2004 138187 | 5/2004 |
| JP | 2007 107616 | 4/2007 |
| JP | 2010 190261 | 9/2010 |
| JP | 2012 13160 | 1/2012 |

OTHER PUBLICATIONS

Extended European Search Report dated Jan. 5, 2016 in Patent Application No. 13863552.9.

* cited by examiner

HYDRAULIC CIRCUIT FOR CONSTRUCTION MACHINE

TECHNICAL FIELD

The present invention relates to a hydraulic circuit for a construction machine capable of regenerating return oil flowing from a boom cylinder, when a boom of, for example, a hydraulic excavator is lowered, as driving power for another hydraulic actuator.

BACKGROUND ART

There will be described a background art of the present invention with reference to an example, a hydraulic excavator shown in FIG. 3. The hydraulic excavator includes a crawler-type lower traveling body 1; an upper slewing body 2 mounted on the lower traveling body 1 so as to be able to be slewed around an axis X perpendicular to a ground; and a front attachment 3 attached to the upper slewing body 2 to perform an operation such as excavation. The front attachment 3 includes a boom 4 mounted on the upper slewing body 2 so as to be able to be raised and lowered; an arm 5 mounted on a distal end of the boom 4; a bucket 6 mounted on a distal end of the arm 5; and a plurality of hydraulic cylinders for actuating the boom 4, the arm 5, and the bucket 6, respectively, namely, a boom cylinder 7, an arm cylinder 8, and a bucket cylinder 9. On the hydraulic excavator, further mounted are a traveling motor which is a hydraulic motor for causing the lower traveling body 1 to travel and a slewing motor which is a hydraulic motor for slewing the upper slewing body 2.

In this hydraulic excavator, upon lowering the boom 4, there acts potential energy corresponding to a height of the boom 4 on the boom cylinder 7, thus making pressure in hydraulic oil discharged from the boom cylinder 7, namely, return oil, high. From this view point, there has been known a technique for regenerating energy of such a hydraulic actuator as drive force for another hydraulic actuator.

For example, Patent Literature 1 discloses a technique of supplying return oil flowing from a head-side chamber of a boom cylinder to a rod-side circuit of an arm cylinder through a regeneration line, when a combined operation of simultaneously performing a boom lowering operation that is an operation for lowering a boom and an arm pushing operation that is an operation for moving an arm in an arm pushing direction, to thereby increase a speed of the arm pushing action. To a hydraulic circuit having a regeneration function including the technique, provided are: a regeneration valve disposed on a regeneration line and adapted to make an action of opening and closing the regeneration line or to adjust its degree of opening; and a meter-out valve for controlling a flow rate of return oil which flows from a regeneration source (in the foregoing example, a head side of the boom cylinder) to a tank. Respective operations of the regeneration valve and meter-out valve are controlled corresponding to electric signals that are input from a controller as control means.

In the known regeneration-function-provided hydraulic circuit including the technique described in Patent Literature 1, respective actuator circuits for the regeneration source and the regeneration target are always used in only one state where they are connected through a regeneration line, which can involve an inconvenient situation. For example, in the case where signal input from the controller to the regeneration valve or to the meter-out valve becomes abnormal, when a combined operation of simultaneously performing a boom lowering operation and an arm pushing operation, to thereby disable the regeneration valve or the meter-out valve from being controlled, the lowering operation of the boom, which is the regeneration source, cannot be correctly performed.

CITATION LIST

Patent Literature

Patent Literature 1: Japanese Unexamined Patent Publication No. 2010-190261

SUMMARY OF INVENTION

Regardless of the above-described abnormal condition, the hydraulic actuator of the regeneration source can be normally and continuously operated, if it is possible to bring respective hydraulic actuators of a regeneration source and a regeneration targets into a state of being independently operated, that is, if it is possible to make a state of no regeneration function. The present invention is achieved from the foregoing point of view, having an object to provide a hydraulic circuit for a construction machine, the hydraulic circuit having a regeneration function and being changeable between a state of executing at least the regeneration action and a state of stopping the regeneration action. The hydraulic circuit provided by the present invention includes: at least one hydraulic pump that discharges hydraulic oil; a plurality of hydraulic actuators that are operated by supply of the hydraulic oil from the at least one hydraulic pump; a plurality of control valves provided for the hydraulic actuators, respectively, and configured to control the supply of the hydraulic oil from the hydraulic pump to the corresponding hydraulic actuators to thereby control respective operations of the individual hydraulic actuators individually; a regeneration line through which return oil is supplied as a regeneration oil to a regeneration target, the return oil being hydraulic oil returned from a specific hydraulic actuator which is one of the hydraulic actuators to a tank; a regeneration valve disposed on the regeneration line; a meter-out valve configured to control a return flow rate that is a flow rate of oil returned to the tank out of the return oil; and a flow-path selection device that selects a flow path of the return oil from a first flow path that leads the return oil to the regeneration line to cause regeneration action and a second flow path that leads the return oil to the control valve provided for the specific hydraulic actuator to stop the regeneration action.

DESCRIPTION OF EMBODIMENT

Figure 1:
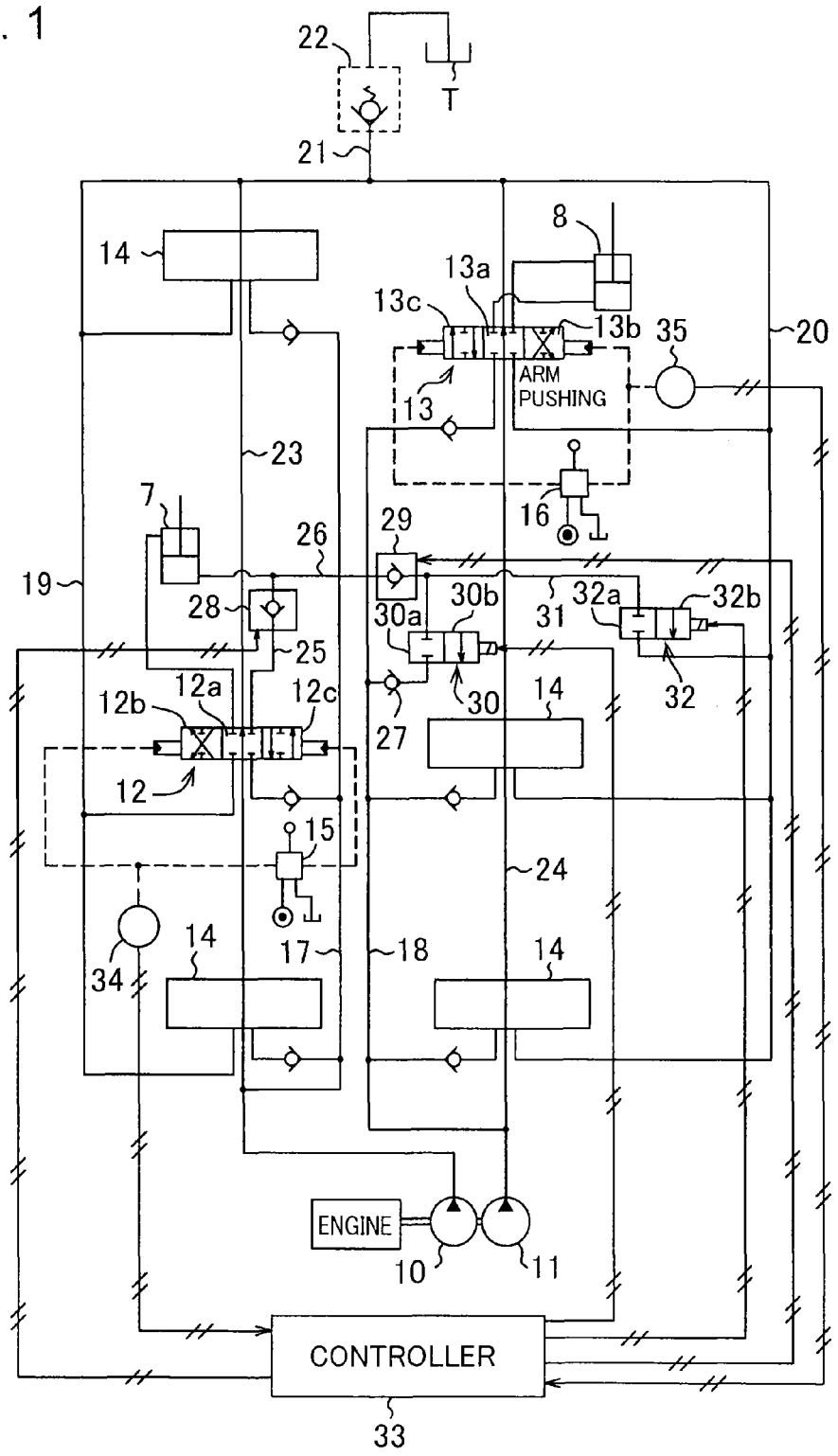
FIG. 1 is a schematic diagram showing a hydraulic circuit according to an embodiment of the present invention.
Figure 3:
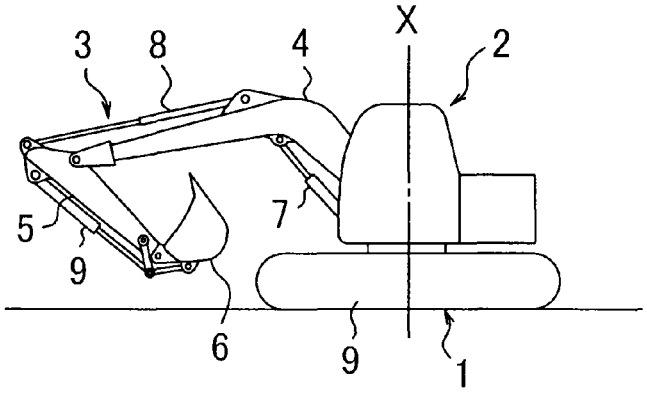
FIG. 3 is a side view showing an outline of a hydraulic excavator as an example of a construction machine according to the present invention.

With reference to the accompanying drawings, a preferable embodiment of the present invention will be described. FIG. 1 shows a hydraulic circuit according to the present embodiment. The hydraulic circuit is provided to the hydraulic excavator shown in FIG. 3.

The hydraulic excavator has hydraulic actuators, all of which are categorized as a first group shown on a left side of FIG. 1 and a second group shown on a right side of FIG. 1. The boom cylinder 7 belongs to the first group; the arm cylinder 8 belongs to the second group; and the other hydraulic actuators are not shown.

The hydraulic circuit includes a first hydraulic pump 10 that discharges hydraulic oil to be supplied to hydraulic actuators belonging to the first group; a second hydraulic pump 11 that discharges hydraulic oil to be supplied to hydraulic actuators belonging to the second group; a plurality of control valves provided for the hydraulic actuators, respectively; a plurality of remote control valves provided for the control valves, respectively; a first center bypass line 23 running through the control valves provided for the hydraulic actuators belonging to the first group, respectively; a second center bypass line 24 running through the control valves provided for the hydraulic actuators belonging to the second group, respectively; a first hydraulic-oil-supply pipe-line 17 arranged in parallel with the first center bypass line 23; a second hydraulic-oil-supply pipe-line 18 arranged in parallel with the second center bypass line 24; a first return pipe-line 19 for leading return oil flowing from the hydraulic actuators belonging to the first group to a tank T; a second return pipe-line 20 for leading return oil flowing from the hydraulic actuators belonging to the second group to the tank T; a tank line 21 connecting the return pipe-lines 19 and 20 with the tank T; and a back-pressure valve 22 disposed on the tank line 21.

The plurality of control valves include a boom control valve 12 provided for the boom cylinder 7; an arm control valve 13 provided for the arm cylinder 8; and a plurality of control valves 14 provided for respective not-graphically-shown hydraulic actuators other than the boom cylinder 7 and the arm cylinder 8. Each of the control valves 12 to 14 is formed of a hydraulic-pilot-controlled three-positions selector valve.

The boom control valve 12 has a neutral position 12*a*, a boom lowering position 12*b*, and a boom raising position 12*c*. In the neutral position 12*a*, the boom control valve 12 forms a flow path opening the first center bypass line 23. In the boom lowering position 12*b*, the boom control valve 12 blocks the first center bypass line 23 and forms an oil path leading hydraulic oil flowing in the first hydraulic-oil-supply pipe-line 17 to a rod-side chamber of the boom cylinder 7 and an oil path leading hydraulic oil in a head-side chamber of the boom cylinder 7 to the first return pipe-line 19, thus causing the boom cylinder 7 to lower the boom 4. In the boom raising position 12*c*, the boom control valve 12 blocks the first center bypass line 23 and forms an oil path leading hydraulic oil flowing in the first hydraulic-oil-supply pipe-line 17 to the head-side chamber of the boom cylinder 7 and an oil path leading hydraulic oil in the rod-side chamber of the boom cylinder 7 to the first return pipe-line 19, thus causing the boom cylinder 7 to raise the boom 4.

The arm control valve 13 has a neutral position 13*a*, an arm pushing position 13*b*, and an arm retracting position 13*c*. In the neutral position 13*a*, the arm control valve 13 forms a flow path opening the second center bypass line 24. In the arm pushing position 13*b*, the arm control valve 13 blocks the second center bypass line 24 and forms an oil path leading hydraulic oil flowing in the second hydraulic-oil-supply pipe-line 18 to a rod-side chamber of the arm cylinder 8 and an oil path leading hydraulic oil in a head-side chamber of the arm cylinder 8 to the second return pipe-line 20, thus causing the arm cylinder 8 to move the arm 5 in the pushing direction. In the arm retracting position 12*c*, the arm cylinder 8 blocks the second center bypass line 24 and forms an oil path leading hydraulic oil flowing in the second hydraulic-oil-supply pipe-line 18 to the head-side chamber of the arm cylinder 8 and an oil path leading hydraulic oil in the rod-side chamber of the arm cylinder 8 to the second return pipe-line 20, thus causing the arm cylinder 8 to move the arm 5 in the retracting direction.

Similarly to the boom control valve 12 and the arm control valve 13, each of the other control valves 14 has a neutral position for opening the corresponding center bypass line and two drive positions for allowing the corresponding hydraulic actuator to be supplied with and discharge hydraulic oil.

In other words, each of the control valves 12 to 14 has a pump port and a tank port, the pump ports of the control valves that belong to the first group and the second group being connected to the first and second hydraulic-oil-supply pipe-lines 17 and 18, while the tank ports of the control valves that belong to the first group and the second group being connected to the first and second return pipe-lines 19 and 20.

The plurality of remote control valves include a boom remote control valve 15 provided for the boom control valve 12; an arm remote control valve 16 provided for the arm control valve 13; and other remote control valves (not shown) provided for the other control valves 14. Each of the remote control valves has an operation lever to which an operation for moving the corresponding control valve is applied, and outputs pilot pressure corresponding to the operation applied to the operation lever. The pilot pressure is input to the pilot port of the corresponding control valve to operate the corresponding control valve.

The hydraulic circuit according to the present embodiment has a regeneration function of supplying regeneration oil which is highly pressurized return oil flowing from the head-side chamber of the boom cylinder 7 which is the specific hydraulic actuator according to the present invention and the regeneration source to the rod-side chamber of the arm cylinder 8 which is the regeneration target, upon a combined operation of simultaneously performing a boom lowering operation and an arm pushing operation. The hydraulic actuator further includes a flow-path selection device that selects the flow path of return oil flowing from the boom cylinder 7, which is the specific hydraulic actuator, from a first flow path that causes the regeneration action to be made and a second flow path that prevents the regeneration action from being made.

Specifically, the hydraulic circuit further includes a head side pipe-line 25, a regeneration line 26, a first pilot check valve 28, a second pilot check valve 29, a regeneration valve 30, a branch pipe-line 31, a meter-out valve 32, and a controller 33.

The head side pipe-line 25 connects the head-side chamber of the boom cylinder 7 to the boom control valve 12. The regeneration line 26 branches from the head side pipe-line 25 to reach the second hydraulic-oil-supply pipe-line 18. In the regeneration line 26, disposed is a check valve 27 that prevents hydraulic oil from reversely flowing from the second hydraulic-oil-supply pipe-line 18 to the head-side chamber of the boom cylinder 7.

The first and second pilot check valves 28 and 29 constitute the flow-path selection device along with the controller 33. The first pilot check valve 28 is disposed on the head side pipe-line 25, having a function of preventing oil from flowing from the head side of the boom cylinder 7 to the boom control valve 12. The second pilot check valve 29 is disposed on the regeneration line 26, having a function of preventing oil from flowing from the head side of the boom cylinder 7 to the regeneration line 26.

The regeneration valve 30 is disposed downstream (downstream with respect to a direction of flow of the return oil from the head side of the boom cylinder) of the second pilot check valve 29 in the regeneration line 26. The branch pipe-line 31 branches from the regeneration line 26 at a position between the second pilot check valve 29 and the regeneration valve 30 and reach the second return pipe-line 20. The meter-out valve 32 is disposed on the branch pipe-line 31 and operated to adjust an amount of return oil that flows from the head side of the boom cylinder 7. The regeneration valve 30 and the meter-out valve 32 are formed of respective solenoid valves, having closed positions 30*a* and 32*a* and fully open positions 30*b* and 32*b*, respectively. The controller 33 inputs electric signals to the regeneration valve 30 and the meter-out valve 32 to thereby change respective positions of the valves 30 and 32. The regeneration valve 30 may be selectively changed over between the positions 30*a* and 30*b*. Alternatively, the regeneration valve 30 may be stroked between the positions 30*a* and 30*b* so as to vary the degree of opening thereof. The meter-out valve 32 is stroked between the positions 32*a* and 32*b* so as to vary the degree of opening thereof.

The first and second pilot check valves 28 and 29 are formed of respective solenoid pilot check valves and operated to be opened and closed with electric signals input from the controller 33. In other words, the first and second pilot check valves 28 and 29 are changed over between a state of preventing a reverse flow and a state of permitting flows in both directions. The controller 33 is basically configured to bring the first pilot check valve 28 into the close state (the state of preventing oil from reversely flowing) and to bring the second pilot check valve 29 into the open state (the state of permitting oil to flow in both directions), when a combined operation of simultaneously performing a boom lowering operation and an arm pushing operation is performed, thus forming a first flow path capable of causing the regeneration action. On the other hand, in the case where the signal system between the controller 33 and the regeneration valve 30 or between the controller 33 and the meter-out valve 32 runs into abnormal condition to disable the controller 33 or the meter-out valve 32 from being controlled (hereinafter referred to as a abnormal state), the first pilot check valve 28 is brought into the open state and the second pilot check valve 29 is brought into the closed state. The abnormal condition is, for example, that the selection signal which should be output from the controller 33 for both the valves 30 and 32 actually fails to be output, or that the selection signal which should not be output from the controller 33 for both the valves 30 and 32 has been actually output. The controller 33 can detect the abnormal condition by itself. Alternatively, such an abnormal condition can be detected based on a current measured on a signal output line by an ampere meter.

The hydraulic circuit according to the present embodiment includes, as means for detecting the combined operation of the boom lowering/arm pushing operations in which the regeneration action should be executed, a boom lowering sensor 34 and an arm pushing sensor 35. The boom lowering sensor 34 converts pilot pressure output from the boom remote control valve 15 into an electric signal to thereby detect the boom lowering operation. The arm pushing sensor 35 converts pilot pressure output from the arm remote control valve 16 into an electric signal to thereby detect the arm pushing operation. The electric signals generated by the sensors 34 and 35 are input to the controller 33.

When the combined operation of the boom lowering/arm pushing operations is detected, the controller 33 causes only the second pilot check valve 29 to be opened while keeping the first pilot check valve 28 in the closed state, i.e., reverse-flow prevention state. Thus formed is the first flow path, which causes return oil flowing from the head-side chamber of the boom cylinder 7 to flow only to the regeneration line 26. The return oil is supplied to the rod-side chamber of the arm cylinder 8 through the regeneration valve 30, the check valve 27, the second hydraulic-oil-supply pipe-line 18, and the arm control valve 13, in this order, thereby increasing the speed of the pushing action of the arm 5. Thus supplying return oil flowing from the head-side chamber of the boom cylinder 7 that is the specific hydraulic actuator to the rod-side chamber of the arm cylinder 8 enables the regeneration action to be executed, the allowing potential energy of the boom 4 to be used as pushing force of the arm 5. Meanwhile, the flow of excessive flow rate in the regeneration line 26 is returned to the tank T through the meter-out valve 32.

In the regeneration action, various control operations may be simultaneously executed. For example, there may be executed a control action including: obtaining a maximum regeneration flow rate and a target flow rate permitted to be used for the regeneration action based on a boom lowering target speed specified by a boom lowering operation amount that is an amount of the operation applied to the operation lever of the boom remote control valve 15 and an arm pushing target speed specified by an arm pushing operation amount that is an amount of the operation applied to the operation lever of the arm remote control valve 16; determining a regeneration flow rate used for the regeneration action based on the difference of the flow rates; and increasing or decreasing a discharge amount of the second hydraulic pump 11 connected to the arm cylinder 8 based on the regeneration flow rate.

When an abnormal condition is generated, the controller 33 causes the first pilot check valve 28 to be opened and the second pilot check valve 29 to be closed, thereby forming the second flow path for return oil flowing from the head-side chamber of the boom cylinder 7. The return oil, therefore, does not flow in the regeneration line 26, but normally returns to the tank T through the boom control valve 12 and the return pipe-line 19. Thus selecting the second flow path allows an abnormal operation, for example, losing normal operation of the boom cylinder 7, to be avoided, thus enabling the combined operation of the boom lowering/arm pushing operations to be continued even though the arm speed increasing function has been lost.

Figure 2:
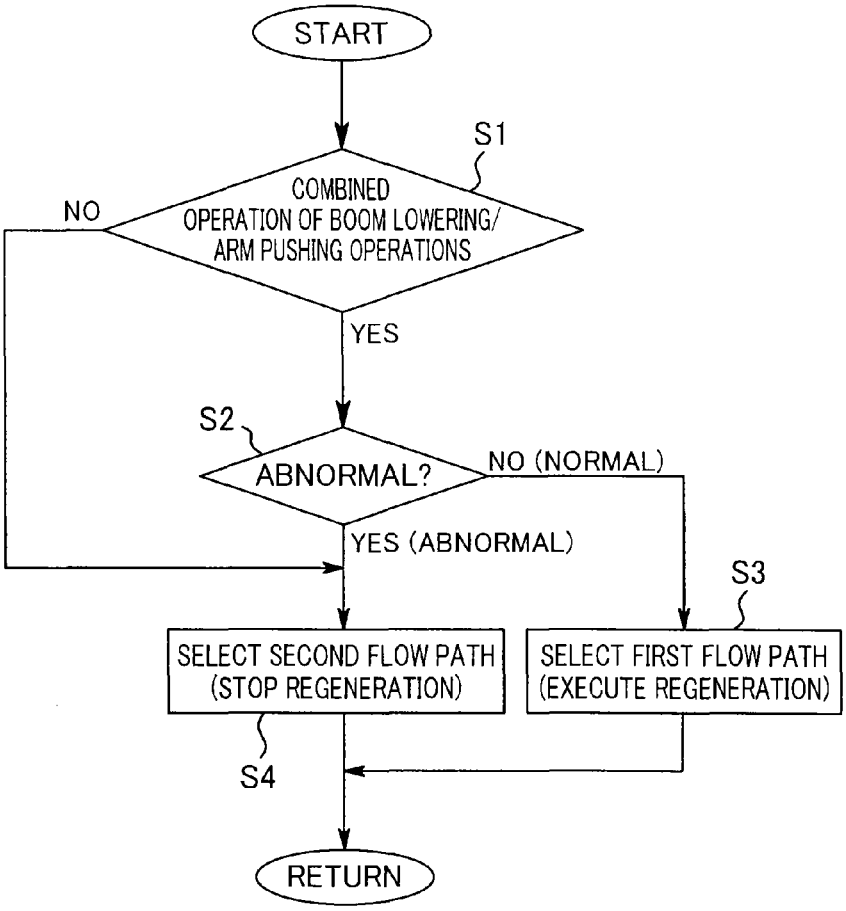
FIG. 2 is a flow chart describing contents of a control of a controller according to the embodiment.

FIG. 2 is a flow chart describing a flow-path selecting control for the controller 33. In step S1, the controller 33 judges whether the combined operation of the boom lowering/arm pushing operations is being performed. In the case of YES in step S1, the controller 33 judges whether or not it is abnormal in step S2. In the case of NO in step S2, that is, the case of normal condition, the controller 33, in step S3, selects the first flow path to cause the regeneration action to be made. In contrast, in the case of YES in step S2, i.e., in the case of abnormal condition, the controller 33, in step S4, selects the second flow path. In the case of NO in step S1, i.e., in the case of no combined operation of the boom lowering/arm pushing operations, where the regeneration action is not required, the controller 33, in step S4, selects the second flow path.

As described above, as for the flow path for return oil flowing from the head-side chamber of the boom cylinder 7, the hydraulic circuit provides the selection between the first path for supplying the return oil to the arm cylinder 8 through the regeneration line 26 to cause the regeneration action and the second flow path for supplying return oil to the boom control valve 12 to stop the regeneration action. This makes it possible to select the first flow path, in normal condition, to utilize potential energy of the boom 4 as regeneration force for increasing the speed of the pushing action of the arm 5 and to select the second flow path for form a regular circuit state with no regeneration action, when the regeneration valve 30 or the meter-out valve 32 becomes abnormal to be uncontrollable, to secure the normal boom operation regardless of the abnormal condition, specifically, to continue the combined operation of the boom lowering/arm pushing operations even though the arm speed increasing function has been lost.

In addition, according to the present embodiment, utilizing the first and second pilot check valves 28 and 29, each of which is a check valve preventing hydraulic oil from leaking, as the flow-path selection device for changing over the flow path allows the circuit structure to be simple compared to the case of preparing the flow-path selection device and dedicated valves, thus allowing facility cost of the circuit to be reduced.

The present invention is not limited to the foregoing embodiment, but includes the following modifications.

(1) As a selectable flow path other than the first flow path for executing the regeneration action and the second flow path for stopping the regeneration action, the first and second paths being selectable according to the foregoing embodiment, there may be added a third flow path formable by opening both of the first and second pilot check valves 28 and 29. The third flow path enables return oil flowing from the head-side chamber of the boom cylinder 7 to be supplied to both the regeneration line 26 and the boom control valve 12.

(2) What abnormal condition triggers the selection of the second flow path is not limited to one on the output from the controller 33. For example, "adhesion" disabling the regeneration valve 30 and the meter-out valve 32 from movement from one position to another position may be detected as the abnormal condition.

(3) While the foregoing embodiment includes selecting the first flow path when the combined operation of the boom lowering/arm pushing operations is performed to cause the regeneration action from the boom cylinder 7 to the arm cylinder 8 to be executed, the combination of a regeneration source and a regeneration target is modifiable. For example, in a hybrid construction machine or an electric construction machine, it is also possible to set a hydraulic motor that is a regeneration motor as a regeneration target and to rotate an electric generator by the regeneration motor for charge of a battery or assist of an engine.

As described above, according to the present invention, provided is a hydraulic circuit for a construction machine, the hydraulic circuit having a regeneration function and being changeable between a state of executing at least the regeneration action and a state of stopping the regeneration action. The hydraulic circuit provided by the present invention includes: at least one hydraulic pump that discharges hydraulic oil; a plurality of hydraulic actuators that are operated by supply of the hydraulic oil from the at least one hydraulic pump; a plurality of control valves provided for the hydraulic actuators, respectively, and configured to control the supply of the hydraulic oil from the hydraulic pump to the corresponding hydraulic actuators to thereby control respective operations of the individual hydraulic actuators individually; a regeneration line through which return oil is supplied as a regeneration oil to a regeneration target, the return oil being hydraulic oil returned from a specific hydraulic actuator which is one of the hydraulic actuators to a tank; a regeneration valve disposed on the regeneration line; a meter-out valve configured to control a return flow rate that is a flow rate of oil returned to the tank out of the return oil; and a flow-path selection device that selects a flow path of the return oil from a first flow path that leads the return oil to the regeneration line to cause regeneration action and a second flow path that leads the return oil to the control valve provided for the specific hydraulic actuator to stop the regeneration action.

In the hydraulic circuit, the flow-path selection device can select the flow path for return oil flowing from a specific hydraulic actuator that is a regeneration source from the first flow path for causing the hydraulic oil to be supplied to the regeneration line to execute the regeneration action and the second flow path that causes the return oil to be supplied to the actuator control valve to stop the regeneration action; therefore, even in in the case where the regeneration valve or the meter-out valve becomes abnormal to be uncontrollable, the hydraulic actuator can be adequately and continuously operated by selection of the second flow path for forming a regular circuit state with no regeneration.

The flow-path selection device, for example, preferably includes a first pilot check valve changeable between a state of preventing flow of oil from the specific hydraulic actuator to the control valve and a state of permitting the flow of oil from the specific hydraulic actuator to the control valve; a second pilot check valve disposed upstream of the regeneration valve on the regeneration line and being changeable between a state of preventing flow of oil toward the regeneration valve and a state of permitting the flow of oil toward the regeneration valve; and a controller configured to input, to the first and second pilot check valves, a signal for changing the state of each of the first and second pilot check valves. The utilization of the first and second pilot check valves having the leak prevention function as the flow-path selection device allows the circuit structure to be simple compared to preparing dedicated valves for the leak prevention function and the flow-path selection device, thus allowing facility to be reduced.

The present invention also provides a construction machine including a lower travelling body, an upper slewing body mounted on the lower traveling body so as to be capable of being slewed; a boom attached to the upper slewing body so as to be capable of being raised and lowered; and the above described hydraulic circuit, wherein: the specific hydraulic actuator is a boom cylinder having a head-side chamber and a rod-side chamber and configured to be extended and retracted by supply of hydraulic oil to the head-side chamber and the rod-side chamber to raise and lower the boom; the hydraulic circuit includes a head side pipe-line connecting the head-side chamber of the boom cylinder to a control valve provided for the boom cylinder, and the regeneration line branches from the head side pipe-line.

In the construction machine, selecting the first flow path to regenerate the return oil flowing from the boom cylinder for another hydraulic circuit enables potential energy of the boom to be utilized for power of another hydraulic actuator, and selecting the second flow path in the case where the regenerated power is not required or cannot be utilized allows the regular operation without the regeneration action to be secured.

For example, in the case where the construction machine includes an arm rotatably connected to a distal end of the boom and the hydraulic circuit includes, as the other hydraulic actuator, an arm cylinder having a head-side chamber and a rod-side chamber and configured to be extended and retracted by supply of hydraulic oil to the head-side chamber and the rod-side chamber, to cause the arm to rotationally move in a pushing direction and a retracting direction, it is preferable to connect the regeneration line to the rod-side chamber of the arm cylinder as the regeneration target. In this case, selecting the first flow path, for example, when a combined operation of simultaneously performing a boom lowering operation and an arm pushing operation is performed, allows return oil flowing from the head side of the boom cylinder to be supplied to the rod-side chamber of the arm cylinder to thereby increase the speed of the pushing operation of the arm, whereas selecting the second flow path when the regeneration valve or the meter-out valve is uncontrollable allows the combined operation of the boom lowering/arm pushing operations to be continued even though the arm speed increasing function has been lost.

The invention claimed is:

1. A hydraulic circuit for a construction machine, comprising:

at least one hydraulic pump that discharges hydraulic oil;

a plurality of hydraulic actuators that are operated by supply of the hydraulic oil from the at least one hydraulic pump;

a plurality of control valves provided for the plurality of hydraulic actuators, respectively, and configured to control the supply of the hydraulic oil from the at least one hydraulic pump to corresponding hydraulic actuators to thereby control respective operations of the corresponding hydraulic actuators individually;

a regeneration line through which return oil is supplied as a regeneration oil to a regeneration target, the return oil being hydraulic oil returned from a specific hydraulic actuator which is one of the hydraulic actuators to a tank;

a regeneration valve disposed on the regeneration line;

a meter-out valve configured to control a return flow rate that is a flow rate of hydraulic oil returned to the tank out of the return oil; and a flow-path selection device that selects a flow-path of the return oil from a first flow-path that leads the return oil to the regeneration line to cause regeneration action and a second flow path that leads the return oil to a specific control valve that is one of the plurality of control valves and is provided for the specific hydraulic actuator to stop the regeneration action, the flow-path selection device including a controller, wherein:

the regeneration valve and the meter-out valve are formed of respective solenoid valves each being operated by a signal input from the controller, and the controller detects an abnormal condition of the regeneration valve and the meter-out valve, and changes the flow path of the return oil to the second flow path upon detecting the abnormal condition.

2. The hydraulic circuit for a construction machine according to claim 1, wherein the flow-path selection device includes:

a first pilot check valve changeable between a state of preventing flow of oil from the specific hydraulic actuator to the specific control valve and a state of permitting the flow of oil from the specific hydraulic actuator to the specific control valve; a second pilot check valve disposed upstream of the regeneration valve on the regeneration line and being changeable between a state of preventing flow of oil toward the regeneration valve and a state of permitting the flow of oil toward the regeneration valve; and the controller configured to input, to each of the first and second pilot check valves; a signal for changing the state of each of the first and second pilot check valves.

3. A construction machine, comprising:

a lower traveling body;

an upper stewing body mounted on the lower traveling body so as to be capable of being freely stewed;

a boom attached to the upper stewing body so as to be capable of being raised and lowered; and the hydraulic circuit according to claim 1, wherein: the specific hydraulic actuator is a boom cylinder having a head-side chamber and a rod-side chamber and configured to be extended and retracted by supply of hydraulic oil to the head-side chamber and the rod-side chamber, to raise and lower the boom; the hydraulic circuit includes a head side pipe-line connecting the head-side chamber of the boom cylinder to the specific control valve provided for the boom cylinder, and the regeneration line branches from the head side pipe-line.

4. The construction machine according to claim 3, further comprising an arm rotatably connected to an end of the boom, wherein the hydraulic circuit includes, as another other hydraulic actuator, an arm cylinder having a head-side chamber and a rod-side chamber and configured to be extended and retracted by supply of hydraulic oil to the head-side chamber and the rod-side chamber, so as to cause the arm to rotationally move in a pushing direction and a retracting direction; and the regeneration line is connected to the rod-side chamber of the arm cylinder as the regeneration target.

* * * * *